US006648754B2

(12) United States Patent
Baerlocher et al.

(10) Patent No.: US 6,648,754 B2
(45) Date of Patent: Nov. 18, 2003

(54) GAMING DEVICE HAVING AN OFFER AND ACCEPTANCE GAME WITH TERMINATION LIMIT WHEREIN THE OFFER IS PICKED BY A PLAYER

(75) Inventors: Anthony J. Baerlocher, Reno, NV (US); Bayard S. Webb, Sparks, NV (US)

(73) Assignee: IGT, Reno, NV (US)

( * ) Notice: Subject to any disclaimer, the term of this patent is extended or adjusted under 35 U.S.C. 154(b) by 131 days.

(21) Appl. No.: 09/822,711

(22) Filed: Mar. 30, 2001

(65) Prior Publication Data

US 2002/0142822 A1 Oct. 3, 2002

(51) Int. Cl.[7] ..... A63F 9/24

(52) U.S. Cl. ..... 463/17; 463/16; 463/20; 463/12

(58) Field of Search ..... 463/20, 26, 12, 463/16, 17

(56) References Cited

U.S. PATENT DOCUMENTS

| | | | | |
|---|---|---|---|---|
| 4,448,419 | A | 5/1984 | Telnaes | |
| 4,582,324 | A | 4/1986 | Koza et al. | |
| 4,624,459 | A | 11/1986 | Kaufman | |
| 4,695,053 | A | 9/1987 | Vazquez, Jr. et al. | |
| 4,871,171 | A | * 10/1989 | Rivero | 463/20 |
| 4,991,848 | A | 2/1991 | Greenwood et al. | |
| 5,178,390 | A | 1/1993 | Okada | |
| 5,205,555 | A | 4/1993 | Hamano | |
| 5,342,047 | A | 8/1994 | Heidel et al. | |
| 5,456,465 | A | 10/1995 | Durham | |
| 5,524,888 | A | 6/1996 | Heidel | |
| 5,536,016 | A | 7/1996 | Thompson | |
| 5,542,669 | A | 8/1996 | Charron et al. | |

(List continued on next page.)

FOREIGN PATENT DOCUMENTS

| | | |
|---|---|---|
| EP | 0 874 337 A1 | 10/1998 |
| EP | 0926645 A2 | 6/1999 |
| EP | 0 944 030 A2 | 9/1999 |
| EP | 0 945 837 A2 | 9/1999 |
| EP | 0 981 119 A2 | 2/2000 |
| EP | 0984408 A2 | 3/2000 |
| EP | 0 984 409 A2 | 3/2000 |
| WO | WO 9732285 | 9/1997 |
| WO | WO 00/12186 | 3/2000 |

OTHER PUBLICATIONS

Marshall Fey, Slot Machines, A Pictorial History of the First 100 Years, 1983, Liberty Belle Press, p. 73.*

Wheel Poker Article written by Strictly Slots (Another Games) published Nov. 2000.

Wheel of Fortune Brochure written by IGT published in 1998.

Totem Pole Brochure written by IGT published in 1997.

MegaJackpots Brochure written by IGT published in 1998.

Wheel of Fortune Brochure written by IGT published in 1999.

Top Dollar Brochure written by IGT published in 1999.

(List continued on next page.)

*Primary Examiner*—Jessica Harrison
*Assistant Examiner*—Corbett B Coburn
(74) *Attorney, Agent, or Firm*—Bell, Boyd & Lloyd LLC

(57) ABSTRACT

The present invention provides a gaming device having a plurality of player selectable selections, steps towards termination associated with each selection, a termination limit and an offer associated with each number of steps. The steps are associated with or determine the offers provided to the player. The game provides no further offers when the maximum number of offers have been awarded, the player accepts an offer, or the player's accumulated steps meet or exceed the termination limit. The game preferably provides a consolation award to the player when the player's steps meet or exceed the termination limit.

32 Claims, 11 Drawing Sheets

U.S. PATENT DOCUMENTS 5,560,603 A 10/1996 Seelig et al.
5,611,535 A 3/1997 Tiberio
5,647,798 A * 7/1997 Falciglia ..... 463/19
5,711,525 A 1/1998 Breeding
5,769,716 A 6/1998 Saffari et al.
5,772,509 A 6/1998 Weiss
5,775,692 A 7/1998 Watts et al.
5,788,573 A 8/1998 Baerlocher et al.
5,823,874 A 10/1998 Adams
5,833,538 A 11/1998 Weiss
5,848,932 A * 12/1998 Adams ..... 463/20
5,851,148 A 12/1998 Brune et al.
5,855,514 A * 1/1999 Kamille ..... 463/17
5,873,781 A 2/1999 Keane
5,882,261 A 3/1999 Adams
5,902,184 A 5/1999 Bennett
5,911,418 A 6/1999 Adams
5,947,820 A 9/1999 Morro et al.
5,951,397 A 9/1999 Dickinson
5,964,463 A 10/1999 Moore, Jr.
5,967,894 A 10/1999 Kinoshita et al.
5,980,384 A 11/1999 Barrie
5,984,781 A 11/1999 Sunaga
5,997,400 A 12/1999 Seelig et al.
5,997,401 A 12/1999 Crawford
6,004,207 A 12/1999 Wilson, Jr. et al.
6,015,346 A 1/2000 Bennett
6,019,369 A 2/2000 Nakagawa et al.
6,033,306 A * 3/2000 De Souza ..... 463/18
6,033,307 A 3/2000 Vancura
6,056,642 A 5/2000 Bennett
6,059,289 A 5/2000 Vancura
6,059,658 A 5/2000 Mangano et al.
6,062,980 A 5/2000 Luciano
6,089,976 A 7/2000 Schneider et al.
6,089,977 A 7/2000 Bennett
6,089,978 A 7/2000 Adams
6,093,102 A 7/2000 Bennett
6,102,798 A 8/2000 Bennett
6,120,031 A 9/2000 Adams
6,126,541 A 10/2000 Fuchs
6,126,542 A 10/2000 Fier
6,142,873 A 11/2000 Weiss et al.
6,142,874 A 11/2000 Kodachi et al.
6,142,875 A 11/2000 Kodachi et al.
6,146,273 A 11/2000 Olsen
6,159,095 A 12/2000 Frohm et al.
6,159,096 A 12/2000 Yoseloff
6,159,097 A 12/2000 Gura
6,159,098 A 12/2000 Slomiany et al.
6,162,121 A 12/2000 Morro et al.
6,168,520 B1 1/2001 Baerlocher et al.
6,168,523 B1 1/2001 Piechowiak et al.
6,173,955 B1 1/2001 Perrie et al.
6,174,233 B1 1/2001 Sunaga et al.
6,174,235 B1 1/2001 Walker et al.
6,190,254 B1 2/2001 Bennett
6,190,255 B1 2/2001 Thomas et al.
6,203,429 B1 * 3/2001 Demar et al. ..... 463/20
6,210,279 B1 4/2001 Dickinson
6,213,876 B1 4/2001 Moore, Jr.
6,224,483 B1 5/2001 Mayeroff
6,231,442 B1 5/2001 Mayeroff
6,231,445 B1 5/2001 Acres
6,261,177 B1 7/2001 Bennett
6,302,790 B1 10/2001 Brossard
6,305,686 B1 10/2001 Perrie et al.
6,309,300 B1 10/2001 Glavich
6,322,309 B1 * 11/2001 Thomas et al. ..... 413/20
6,328,649 B1 12/2001 Randall et al.
6,375,187 B1 4/2002 Baerlocher
6,506,118 B1 1/2003 Baerlocher et al.

OTHER PUBLICATIONS

The Price is Right—Showcase Showdowns Description written by schuminweb.com (web site) printed Mar. 16, 2001.
Take Your Pick written by Strictly Slots IGT/Anchor Games published in 1999, 2001.
Little Green Men Brochure and Article written by IGT Strictly Slots published in 2000.
Bonus Spin Red, White & Blue Advertisement written by IGT published in 2000.
Winning Streak Web Site Description written by WMS Gaming Inc. (web site) printed Mar. 21, 2001.
On the Money Article written by Strictly Slots Casino Data Systems published Dec. 2000.
Money in the Bank written by Strictly Slot Konami published in 2001.
Texas Tea Brochure written by IGT published in 2000.
Let's Make A Deal Brochure written by Shuffle Master IGT published in 2001.
Price is Right "Showcases" Description written by schuminweb.com (web site) printed Mar. 16, 2001.
Price is Right "Cliff Hangers" Description written by www.geocities.com; members.aol.com (web site) printed Mar. 21, 2001.
Jackpot Party Articles and Brochures written by WMS Gaming, Inc. published in 1998.
Blackjack/Twenty–One Description written by Hoyle's Rules of Games published in 1993.
Empire Game Brochure written by AC Coin published in 1996.
Addams Family Advertisement and Article written by IGT, Strictly Slots, published in 2000.
Adders and Ladders Advertisement written by Barcrest Ltd., published prior to 2000.
American Thunder Screen Shots written by IGT, published in 1998.
Big Bang Piggy Bankin Advertisement written by WMS Gaming Inc., published prior to 2000.
Bonus Times Article written by Strictly Slots, published in 2000.
By George written by IGT, published in 2002.
Carribean Gold II Advertisement written by Aristocrat Incorporated, published in 1998.
Cash Box Advertisement & Article written by Anchor Games, Strictly Slots, published in 2000.
Chutes & Ladders Game Instructions written by Hasbro–Milton Bradley, published in 1999.
Description of Let's Make a Deal Television Show written by letsmakeadeal.com (2 pages), printed on Mar. 16, 2001.
Double Diamond Game Descriptions written by IGT printed on Mar. 21, 2001.
Double Up Poker Game Description written by IGT Undated.
Easy Street Advertisements and Articles written by Casino Data Systems, published in 2000.
Elvis Advertisement written by IGT, published in 1999.
Fire and Fortune Article written by Strictly Slots, published in 2001.
Fox "N" Hound Advertisement written by IGT, published in 2000.

In Between Game Description written by IGT, available prior to 2000.
Keep Your Hat On Advertisement written by Aristocrat, published in 2001.
Let's Make a Deal written by geocities.com (10 pages), printed on Mar. 21, 2001.
Let's Make a Deal written by fortunecity.com (4 pages), printed on Mar. 21, 2001.
Let's Make a Deal written by Illinoislottery.com (1 page), printed on Mar. 21, 2001.
Let's Make a Deal geocities.com (2 pages), printed on Mar. 16,2001.
Let's Make a Deal Game Advertisement written by Bally Gaming Systems, published in 1999.
Money Grab Article written by Strictly Slots, published in Apr. 2001.
Monopoly Advertisements and Articles written by WMS Gaming, Inc., Strictly Slots, published in 1998, 1999, 2000.
Monopoly Party Train Article written by Strictly Slots, published in 2002.
Neon Nights written by IGT, published in 2000.
Polly & Roger Advertisement written by VLC, Inc., published in 2000.
Psycho Cash Beast Club (including knockouts) written by Barcrest, published prior to 1998.
Richard Petty Advertisement written by IGT, published in 2000.
South Park—Dodgeball Advertisement written by IGT, published in 2000.
Spell Binder Advertisement written by IGT, published in 2000.
Sphinx Advertisement written by Atronic Casino Technology, Ltd., published in 1997.
The Deals of Let's Make a Deal written by fortunecity.com (2 pages), printed on Mar. 16, 2001.
The Official Let's Make a Deal Website written by Bally Gaming System Website, printed on Mar. 16, 2001.
Top Car Advertisement written by WMS Gaming, Inc., published prior to 2000.
Treasure Wheel/Treasure Tunnel Advertisement written by Sigma Game, Inc., published prior to 2000.
X Factor Advertisement and Website Page written by WMS Gaming, Inc., published in 1998.

* cited by examiner

GAMING DEVICE HAVING AN OFFER AND ACCEPTANCE GAME WITH TERMINATION LIMIT WHEREIN THE OFFER IS PICKED BY A PLAYER

CROSS REFERENCES TO RELATED APPLICATIONS

This application is related to the following commonly-owned co-pending patent applications: "GAMING DEVICE HAVING SEPARATELY CHANGEABLE VALUE AND MODIFIER BONUS SCHEME," Ser. No. 09/626,045, "GAMING DEVICE HAVING A BONUS ROUND WITH MULTIPLE RANDOM AWARD GENERATION AND MULTIPLE RETURN/RISK SCENARIOS," Ser. No. 09/678,989, "GAMING DEVICE HAVING AN AWARD EXCHANGE BONUS ROUND AND METHOD FOR REVEALING AWARD EXCHANGE POSSIBILITIES," Ser. No. 09/689,510, "GAMING DEVICE HAVING GRADUATING AWARD EXCHANGE SEQUENCE WITH A TEASE CONSOLATION SEQUENCE AND AN INITIAL QUALIFYING SEQUENCE," Ser. No. 09/680,601, "GAMING DEVICE HAVING A DESTINATION PURSUIT BONUS SCHEME WITH ADVANCED AND SETBACK CONDITIONS," Ser. No. 09/686,409, "GAMING DEVICE HAVING VALUE SELECTION BONUS," Ser. No. 09/684,605, "GAMING DEVICE HAVING RISK EVALUATION BONUS ROUND," Ser. No. 09/688,434, "GAMING DEVICE HAVING AN IMPROVED OFFER/ACCEPTANCE BONUS SCHEME," Ser. No. 09/966,884, "GAMING DEVICE HAVING IMPROVED OFFER AND ACCEPTANCE BONUS SCHEME," Ser. No. 09/680,630, "GAMING DEVICE HAVING IMPROVED AWARD OFFER BONUS SCHEME," Ser. No. 09/682,368, "GAMING DEVICE HAVING OFFER AND ACCEPTANCE GAME WITH HIDDEN OFFER," Ser. No. 10/160,688, "GAMING DEVICE HAVING OFFER/ACCEPTANCE ADVANCE THRESHOLD AND LIMIT BONUS SCHEME," Ser. No. 09/838,014, "GAMING DEVICE HAVING IMPROVED OFFER AND ACCEPTANCE GAME WITH MASKED OFFERS," Ser. No. 10/086,014, "GAMING DEVICE HAVING AN OFFER AND ACCEPTANCE SELECTION BONUS SCHEME WITH A TERMINATOR AND AN ANTI-TERMINATOR," Ser. No. 09/945,082, "GAMING DEVICE HAVING AN AWARD OFFER AND TERMINATION BONUS SCHEME," Ser. No. 09/682,428, "GAMING DEVICE HAVING AN OFFER AND ACCEPTANCE GAME WITH A PLAYER SELECTION FEATURE," Ser. No. 10/086,078, and "GAMING DEVICE HAVING IMPROVED OFFER AND ACCEPTANCE BONUS SCHEME," Ser. No. 10/074,273.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

DESCRIPTION

The present invention relates in general to a gaming device, and more particularly to a gaming device having an offer and acceptance game with a termination limit.

BACKGROUND OF THE INVENTION

Gaming devices, such as slot, poker, blackjack and keno, having primary and/or secondary or bonus games are well known. One well known game provides a player with a series of offers, where each offer includes a number of credits, coins, tokens or dollars. The player may accept or reject each offer prior to the final offer. The player must accept the final offer. If the player accepts an offer, the game provides the offer to the player. If the player rejects an offer, the gaming device provides another offer to the player, as long as the current offer is not the final offer.

The offers are randomly determined from a series of potential offers of differing values. As illustrated in FIG. 3, the potential offers 100 are displayed to the player (hereafter "offers" 100), each offer provided by the game is displayed in a current offer display 102, the number of offers remaining are displayed in an offers remaining display 104, and accept and reject input devices 106 and 108, respectively, enable the user to accept or reject the offers.

Several different embodiments of this type of game for a gaming device have been implemented in gaming machines of various types. This type of gaming device has achieved significant popularity in the gaming industry. Accordingly, there is a need for new gaming devices related to this type of offer and acceptance game.

SUMMARY OF THE INVENTION

The gaming device of the present invention includes a plurality of player selectable selections, steps towards termination of the bonus game associated with each of the selections, a termination limit of the steps, and an offer associated with each number of steps toward termination. The steps towards the termination limit accompany, are associated with or determine the offers that the game provides to the player. The game provides no further offers when the player's selection makes the accumulated steps exceed the termination limit. The game preferably provides a consolation award to the player when the player's steps exceed the termination limit. Alternatively, these game functions occur when the player's accumulated steps meet the termination limit.

In one embodiment, the game provides a plurality of player selectable masked selections. Each selection functions as a rejection of the current offer after the first offer is made. Therefore, these selections function as a plurality of offer rejections. The game may alternatively provide only one reject offer input device, whereby the player selects or the game randomly selects or provides a new offer. As the player sequentially rejects offers, the steps associated with the offers accumulate or accrue. If the accumulated steps meet or alternatively exceed a preset termination limit, the gaming device revokes all offers and ends the game as described above.

In one embodiment, the present invention includes a display device, processor adapted to communicate with said display device and to accrue a plurality of steps, a step generator adapted to communicate with the processor, a plurality of offers associated with the accrued steps, a termination limit including a plurality of accrued steps, at least one offer acceptance indicator adapted to communicate with the processor and at least one offer rejection indicator adapted to communicate with the processor. In this embodiment, the step generator is adapted to generate the steps, the processor is adapted to accrue the steps and the display device is adapted to display the steps and offers until the accrued steps exceed the termination limit, a player uses the offer rejection indicator to reject all the offers associated with the accrued steps or the player uses the offer acceptance indicator to accept an offer associated with the accrued steps.

A method for operating the gaming device of the present invention includes the steps of: (i) providing a number of steps and an offer associated with the player's accumulated steps to the player; (ii) enabling the player to accept or reject the provided offer; (iii) ending the game if the player's steps towards termination meet or alternatively exceed the termination limit; and (iv) enabling the player to select a new offer if the player's steps towards termination do not meet or alternatively exceed the termination limit. The termination limit functions as a limit to the number of new offers (i.e., a maximum number of offers) that the player may obtain. Accordingly, in each game, the number of potential offers may vary and in other embodiments, it may be fixed. The game includes additionally providing a maximum offer amount, which when reached, terminates the game. In one embodiment, the termination limit is fixed. In another, the game provides different termination limits at different times.

The game preferably terminates when the player reaches the maximum number of possible offers, the maximum offer amount, or rejects too many offers such that the player's accrued steps towards termination which determine the offers made to the player exceed the termination limit. The player is thus forced to predict when the next offer, which may or may not be larger than the previous offer, will have an associated number of steps to cause termination of the game and must thereby decide when to accept the current offer. If the player accepts the current offer, the game awards the offer to the player.

The game also preferably provides a non-instantaneous or delayed reveal which adds excitement and enjoyment to the game. When the player rejects an offer, the game displays the steps accruing one at a time on an indicator in accordance with the theme of the game. The player does not know when or where the accrual will stop. The player hopes the indicator will designate a valuable offer and also hopes the indicator does not accrue steps that meet or alternatively exceed the termination limit. The improved delayed or non-instantaneous reveal provides more excitement and enjoyment than simply instantaneously revealing the accrued number of steps.

It is therefore an advantage of the present invention to provide a gaming device with an offer and acceptance bonus game wherein the game enables the player to obtain offers until the player accepts an offer, meets or exceeds a termination limit or runs out of offers.

It is another advantage of the present invention to provide a gaming device which non-instantaneously reveals outcomes to increase enjoyment and excitement.

Other objects, features and advantages of the invention will be apparent from the following detailed disclosure, taken in conjunction with the accompanying sheets of drawings, wherein like numerals refer to like parts, elements, components, steps and processes.

DETAILED DESCRIPTION OF THE INVENTION

Gaming Device and Electronics

Figure 1A:
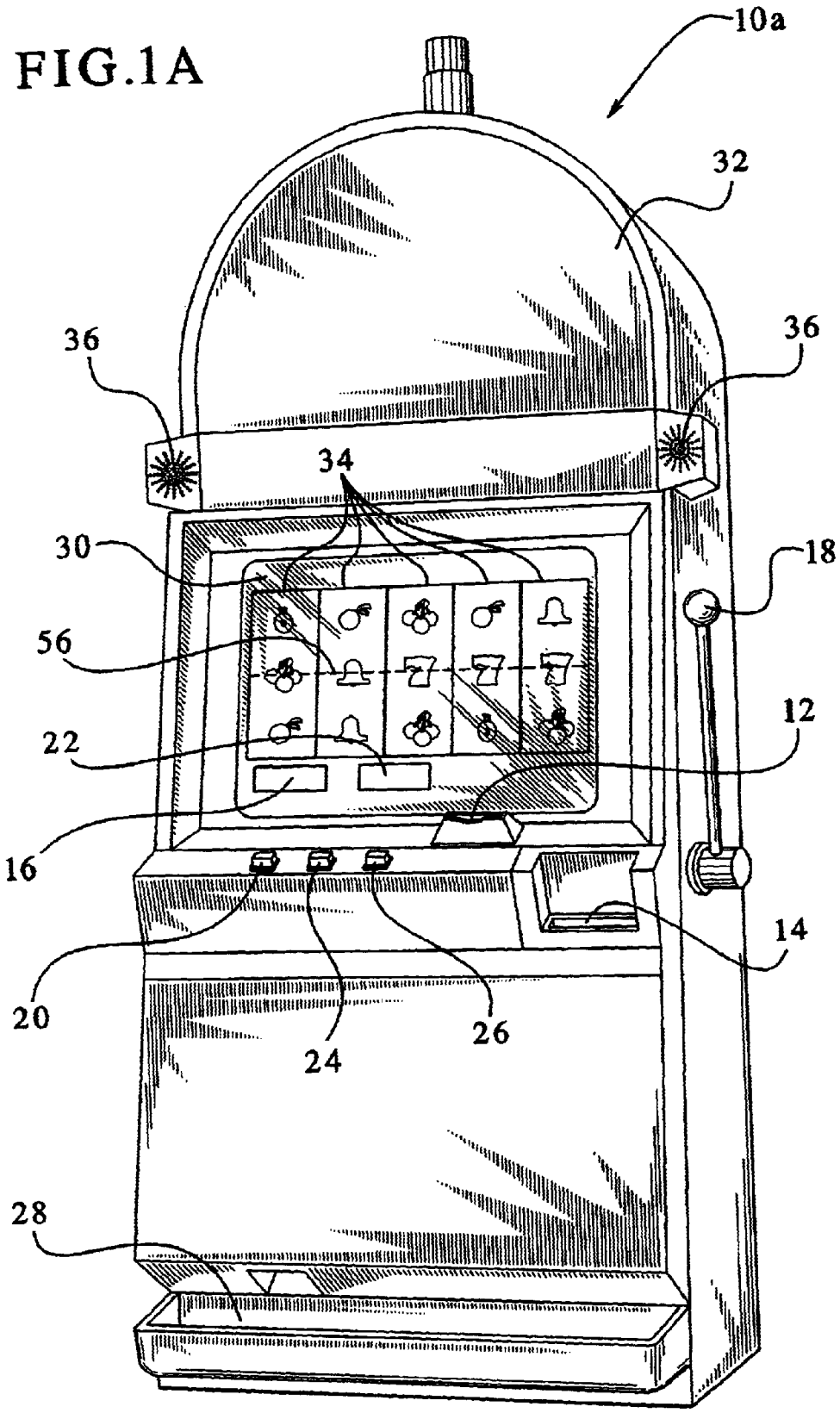
FIGS. 1A and 1B are perspective views of alternative embodiments of the gaming device of the present invention.
Figure 1B:
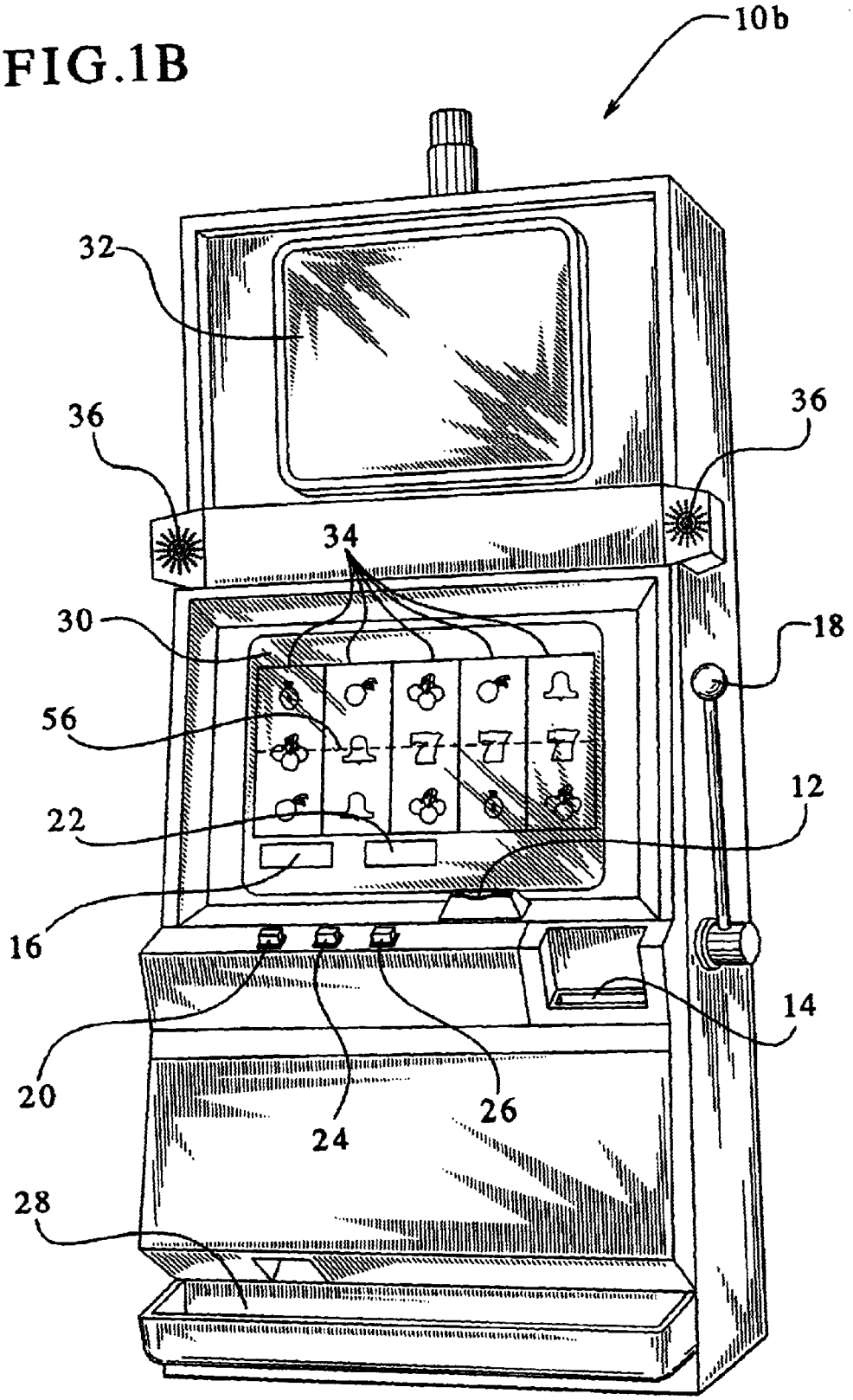

Referring now to the drawings, and in particular to FIGS. 1A and 1B, gaming device 10*a* and gaming device 10*b* illustrate two possible cabinet styles and display arrangements and are collectively referred to herein as gaming device 10. The present invention includes the game (described below) being a stand alone game or a bonus or secondary game that coordinates with a base game. When the game of the present invention is a bonus game, gaming device 10 in one base game is a slot machine having the controls, displays and features of a conventional slot machine, wherein the player operates the gaming device while standing or sitting. Gaming device 10 also includes being a pub-style or table-top game (not shown), which a player operates while sitting.

The base games of the gaming device 10 include slot, poker, blackjack or keno, among others. The gaming device 10 also embodies any bonus triggering events, bonus games as well as any progressive game coordinating with these base games. The symbols and indicia used for any of the base, bonus and progressive games include mechanical, electrical or video symbols and indicia.

In a stand alone or a bonus embodiment, the gaming device 10 includes monetary input devices. FIGS. 1A and 1B illustrate a coin slot 12 for coins or tokens and/or a payment acceptor 14 for cash money. The payment acceptor 14 also includes other devices for accepting payment, such as readers or validators for credit cards, debit cards or smart cards, tickets, notes, etc. When a player inserts money in gaming device 10, a number of credits corresponding to the amount deposited is shown in a credit display 16. After depositing the appropriate amount of money, a player can begin the game by pulling arm 18 or pushing play button 20. Play button 20 can be any play activator used by the player which starts any game or sequence of events in the gaming device.

As shown in FIGS. 1A and 1B, gaming device 10 also includes a bet display 22 and a bet one button 24. The player places a bet by pushing the bet one button 24. The player can increase the bet by one credit each time the player pushes the bet one button 24. When the player pushes the bet one button 24, the number of credits shown in the credit display 16 decreases by one, and the number of credits shown in the bet display 22 increases by one. At any time during the game, a player may "cash out" by pushing a cash out button 26 to receive coins or tokens in the coin payout tray 28 or other forms of payment, such as an amount printed on a ticket or credited to a credit card, debit card or smart card. Well known ticket printing and card reading machines (not illustrated) are commercially available.

Gaming device 10 also includes one or more display devices. The embodiment shown in FIG. 1A includes a central display device 30, and the alternative embodiment shown in FIG. 1B includes a central display device 30 as well as an upper display device 32. The display devices display any visual representation or exhibition, including but not limited to movement of physical objects such as mechanical reels and wheels, dynamic lighting and video images. The display device includes any viewing surface such as glass, a video monitor or screen, a liquid crystal display or any other static or dynamic display mechanism. In a video poker, blackjack or other card gaming machine embodiment, the display device includes displaying one or more cards. In a keno embodiment, the display device includes displaying numbers.

The slot machine base game of gaming device 10 preferably displays a plurality of reels 34, preferably three to five reels 34, in mechanical or video form on one or more of the display devices. Each reel 34 displays a plurality of indicia such as bells, hearts, fruits, numbers, letters, bars or other images which preferably correspond to a theme associated with the gaming device 10. If the reels 34 are in video form, the display device displaying the video reels 34 is preferably a video monitor. Each base game, especially in the slot machine base game of the gaming device 10, includes speakers 36 for making sounds or playing music.

Figure 2:
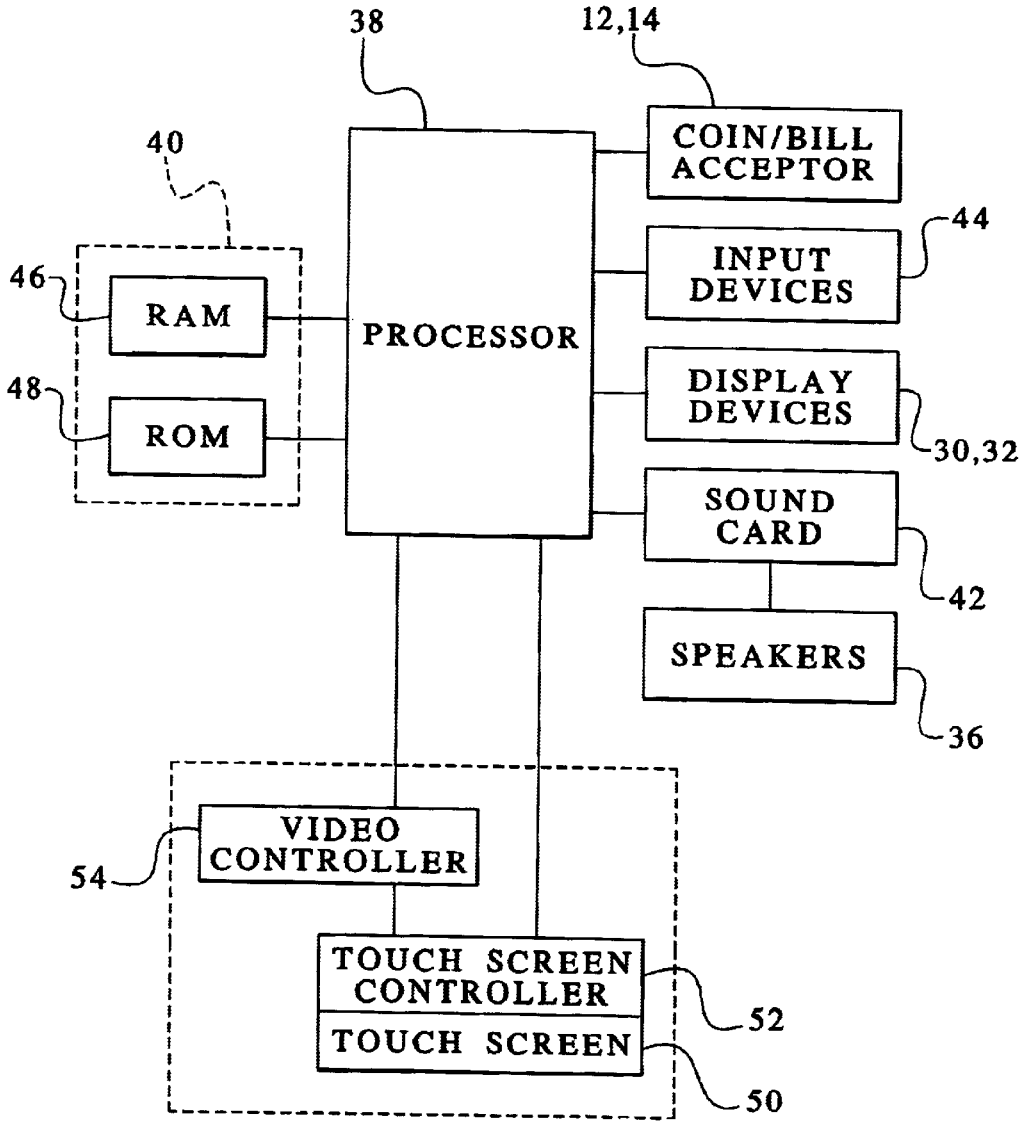
FIG. 2 is a schematic block diagram of the electronic configuration of one embodiment of the gaming device of the present invention.

Referring now to FIG. 2, a general electronic configuration of the gaming device 10 for the stand alone and bonus embodiments described above preferably includes: a processor 38; a memory device 40 for storing program code or other data; a central display device 30; an upper display device 32; a sound card 42; a plurality of speakers 36; and one or more input devices 44. The processor 38 is preferably a microprocessor or microcontroller-based platform which is capable of displaying images, symbols and other indicia such as images of people, characters, places, things and faces of cards. The memory device 40 includes random access memory (RAM) 46 for storing event data or other data generated or used during a particular game. The memory device 40 also includes read only memory (ROM) 48 for storing program code, which controls the gaming device 10 so that it plays a particular game in accordance with applicable game rules and pay tables.

As illustrated in FIG. 2, the player preferably uses the input devices 44 to input signals into gaming device 10. In the slot machine base game, the input devices 44 include the pull arm 18, play button 20, the bet one button 24 and the cash out button 26. A touch screen 50 and touch screen controller 52 are connected to a video controller 54 and processor 38. The terms "computer" or "controller" are used herein to refer collectively to the processor 38, the memory device 40, the sound card 42, the touch screen controller and the video controller 54.

In certain instances, it is preferable to use a touch screen 50 and an associated touch screen controller 52 instead of a conventional video monitor display device. The touch screen enables a player to input decisions into the gaming device 10 by sending a discrete signal based on the area of the touch screen 50 that the player touches or presses. As further illustrated in FIG. 2, the processor 38 connects to the coin slot 12 or payment acceptor 14, whereby the processor 38 requires a player to deposit a certain amount of money in to start the game.

It should be appreciated that although a processor 38 and memory device 40 are preferable implementations of the present invention, the present invention also includes being implemented via one or more application-specific integrated circuits (ASIC's), one or more hard-wired devices, or one or more mechanical devices (collectively referred to herein as a "processor"). Furthermore, although the processor 38 and memory device 40 preferably reside in each gaming device 10 unit, the present invention includes providing some or all of their functions at a central location such as a network server for communication to a playing station such as over a local area network (LAN), wide area network (WAN), Internet connection, microwave link, and the like.

With reference to the slot machine base game of FIGS. 1A and 1B, to operate the gaming device 10, the player inserts the appropriate amount of tokens or money in the coin slot 12 or the payment acceptor 14 and then pulls the arm 18 or pushes the play button 20. The reels 34 then begin to spin. Eventually, the reels 34 come to a stop. As long as the player has credits remaining, the player can spin the reels 34 again. Depending upon where the reels 34 stop, the player may or may not win additional credits.

In addition to winning base game credits, the gaming device 10, including any of the base games disclosed above, also includes bonus games that give players the opportunity to win credits. The gaming device 10 preferably employs a video-based display device 30 or 32 for the bonus games. The bonus games include a program that automatically begins when the player achieves a qualifying condition in the base game.

In the slot machine embodiment, the qualifying condition includes a particular symbol or symbol combination generated on a display device. As illustrated in the five reel slot game shown in FIGS. 1A and 1B, the qualifying condition includes the number seven appearing on, e.g., three adjacent reels 34 along a payline 56. It should be appreciated that the present invention includes one or more paylines, such as payline 56, wherein the paylines can be horizontal, diagonal or any combination thereof. An alternative scatter pay qualifying condition includes the number seven appearing on, e.g., three adjacent reels 34 but not necessarily along a payline 56, appearing on any different set of reels 34 three times or appearing anywhere on the display device the necessary number of times.

Offer/Acceptance Termination Limit

Figure 3:
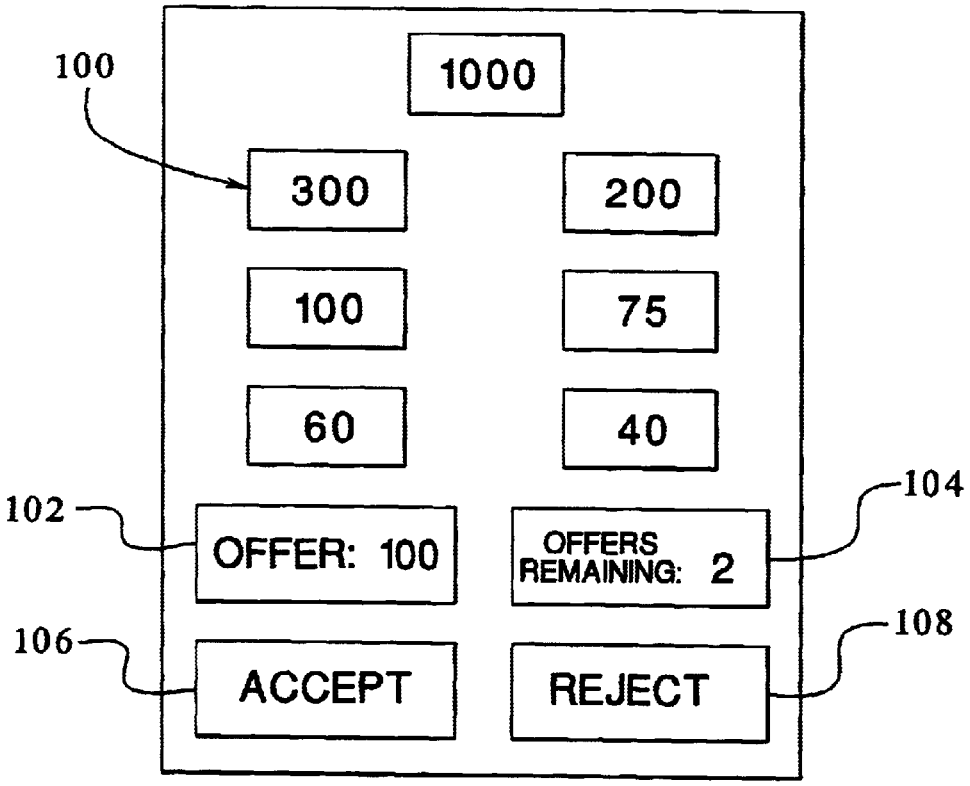
FIG.3 (PRIOR ART)
FIG. 3 is a front elevational view of a known offer and acceptance game.
Figure 4A:
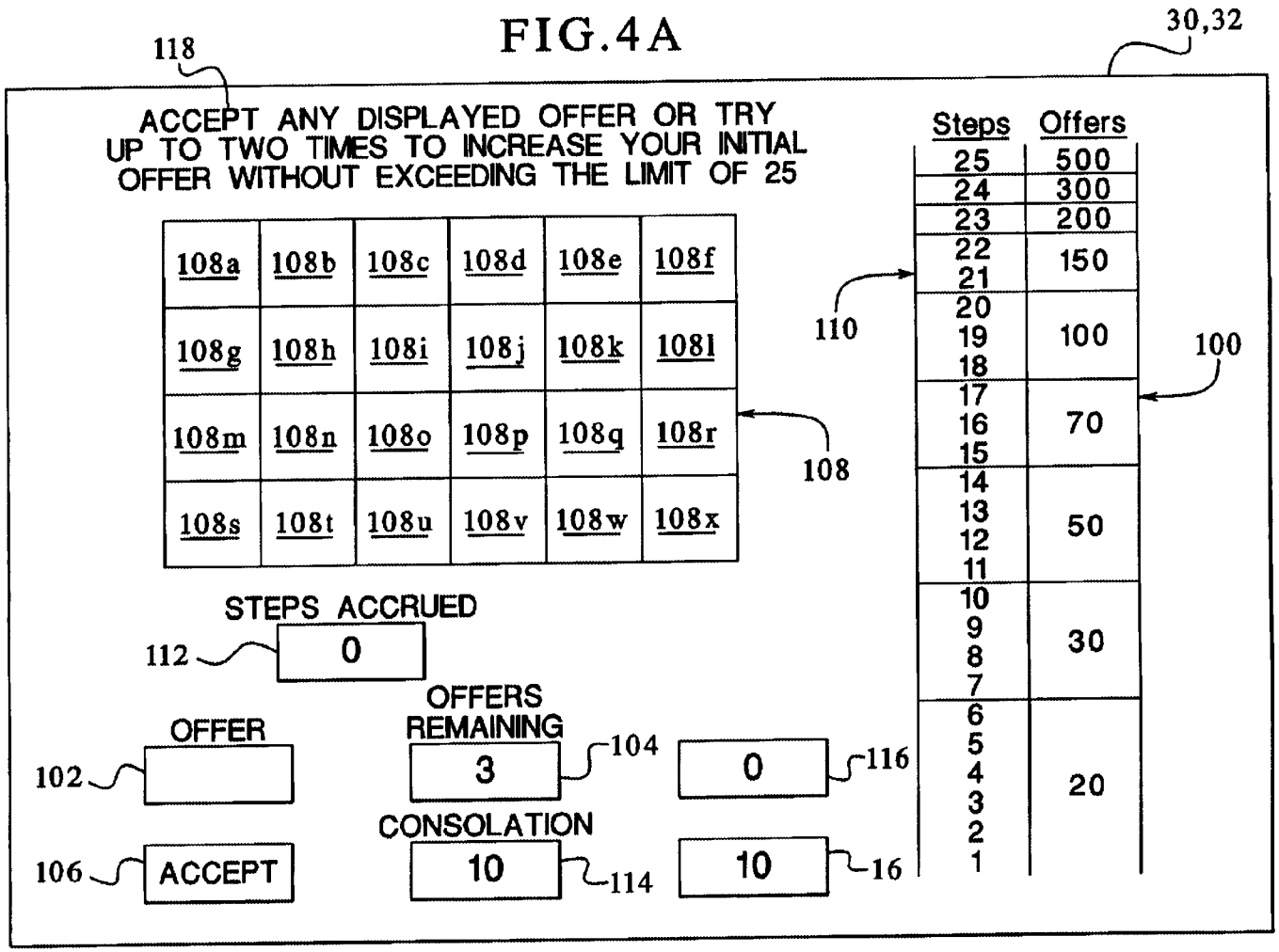
FIGS. 4A and 4B are front elevational views of one of the display devices of FIGS. 1A and 1B generally illustrating one preferred embodiment, wherein the game includes a termination limit and a plurality of revealed offers having an associated number of steps towards the termination limit.

Referring now to FIG. 4A, one embodiment is generally illustrated by one of the display devices 30 or 32. Specifically, this embodiment includes the offers 100, the current offer display 102, the offers remaining display 104 and the accept and reject input devices 106 and 108, respectively, of FIG. 3. In one preferred embodiment, the plurality of offers 108*a* to 108*x* which the player may select from functions as a plurality of reject input devices which, when selected, reveal the steps which determine the player's offer as described in more detail below. Thus, if the player desires to keep an offer, the player selects the accept input device 106. If the player desires to reject an offer, the player selects one of the masked selections 108*a* through 108*x* which function as reject current offer input devices. It should be appreciated that the present invention also includes providing a single reject current offer input device. In this multiple reject input device embodiment (e.g., reject input devices 108*a* through 108*x*), the game randomly assigns the number of steps associated with each selection to the player's selection. In this manner, the player at least in part determines the player's outcome and specifically the player's offer. In prior known offer acceptance games, the game randomly determined the offer made to the player.

As briefly mentioned above, the preferred embodiment displays a plurality of steps 110. In the preferred embodiment, one or more sequential steps 110 correspond to different offers. The number of and the value of the steps 110 and the ranges of steps are variables that the game implementor sets according to a preferred mathematical algorithm for a particular implementation of the present invention.

The display 30 or 32 includes: (a) steps accrued display 112 which indicates the amount of accrued steps; (b) a consolation display 114 which indicates the value of any consolation award that the game provides if the player exceeds the termination limit; (c) a paid display 116 which indicates the value of an offer paid to the player; and (d) a credit display 16 which shows the recently paid offer plus the player's previous total award. In an example illustrated in FIG. 4A, the player begins a game of the present invention with ten credits as indicated by the credit display 16. The game in FIG. 4A has yet to pay the player any credits, as indicated by the paid display 116.

The game preferably employs a touch screen 50 (FIG. 3) and a touch screen controller 52 (FIG. 3) such that the accept and reject input devices 106 and 108, respectively, are separate player selectable areas on the video monitor which adapted to send discrete inputs to the processor 38 (FIG. 3). The game may alternatively provide one or more lighted mechanical indicators for the displays and input devices. The offers and the consolation award are preferably any credits, credit multipliers or represent other items of value such as a number of picks from a prize pool. The offers and consolation awards include having any value desired by the implementor.

The example in FIG. 4A includes offers 100 ranging from twenty to five hundred and a consolation award of ten (which the game may alternatively hide from the player). The present invention includes providing any offer values and any consolation award having any relative value relationship to the offer values. The present invention also includes changing the consolation award and the offers in different bonus games or alternatively providing the same consolation award and/or offers in each bonus game of the gaming device.

Figure 4B:
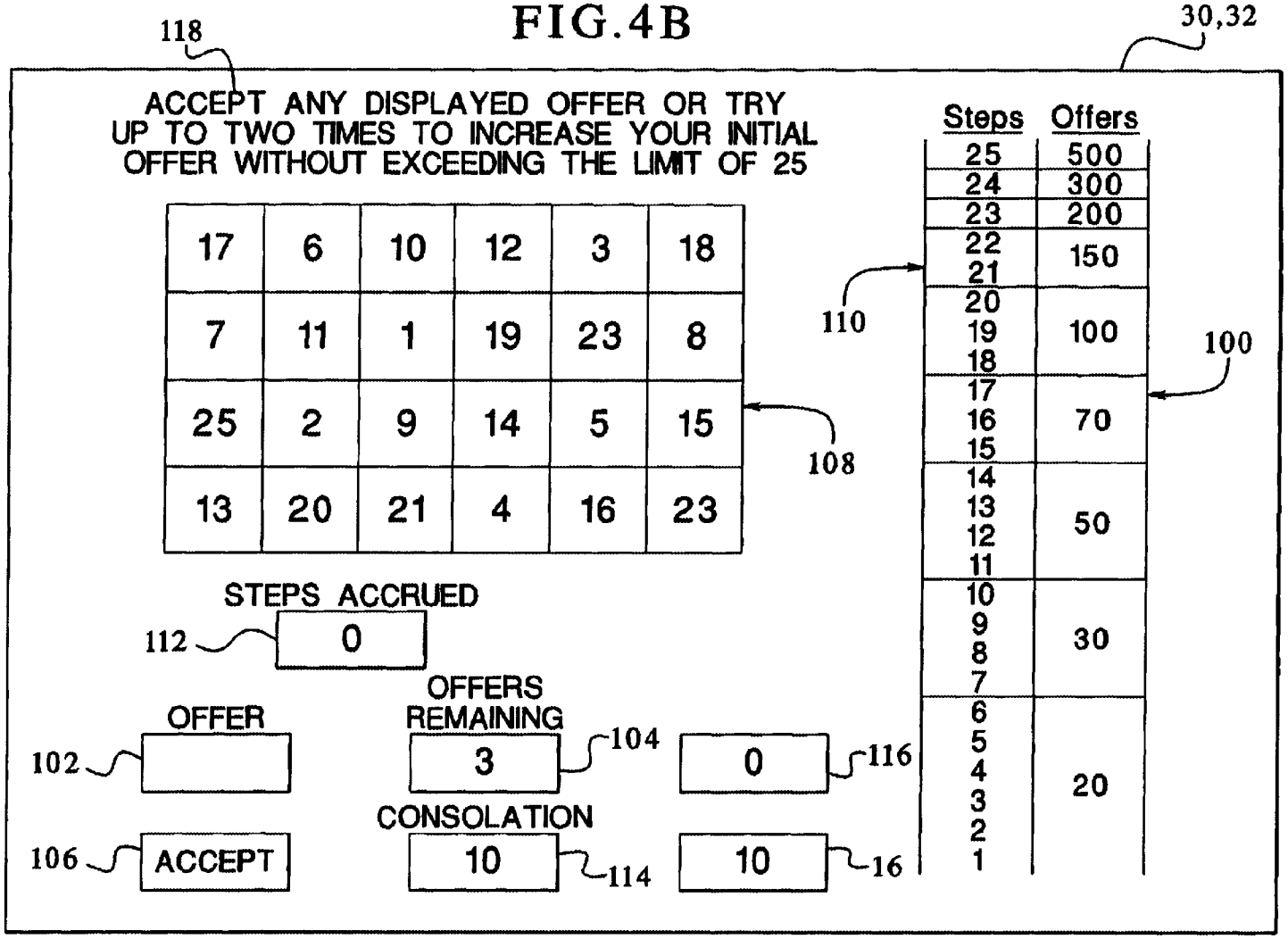

The processor 38 employs one or more well known random generation methods to randomly place or associate one of the displayed steps 110 with each selection (or the reject current offer input device) 108*a* through 108*x*. FIG. 4B illustrates a random placement or association of the displayed steps 110 with each selection (or any reject current offer input device) 108*a* through 108*x*. FIG. 4B illustrates that the present invention includes not associating or placing one or more possible steps 110 with a selection (i.e., steps twenty-two and twenty-four are not associated with any of the selections 108*a* through 108*x*, as illustrated in FIGS. 4A and 4B). FIG. 4B further illustrates that the present invention includes associating or placing one or more steps 110 with a plurality of selections (i.e., step twenty-three is associated with 108*k* and 108*x*, as illustrated in FIGS. 4A and 4B). The game implementor may alternatively select the steps and number of their associations based on a preferred mathematical algorithm for a particular implementation of the present invention. Weighted probabilities may also be associated with each of the steps, such that certain steps are associated with the selections on average more frequently than other steps.

As illustrated, the game preferably chooses the steps to place behind the selections 108*c* through 108*x*, from the steps 110 that the game displays to the player. The game is not limited to only using displayed steps. The present invention includes the game generating a number of steps that are not displayed. The present invention includes providing a number of steps wherein the number is zero steps, a negative number of steps, partial steps and a number of steps larger than the largest displayed step 110. The present invention also includes suitable non-numerical steps such as letters or other symbols. FIGS. 4A and 4B illustrate twenty-five different steps 110 and twenty-four selections 108*a* through 108*x*; therefore, in the preferred embodiment, one of the steps 110 is certain not to be associated with a selection.

FIGS. 4A and 4B display nine different offers 100, wherein each is associated with a single step 110 or range or set of steps 110. The game provides the offer 100 to a player that is associated with the player's accumulated number of steps. For instance, in the example of FIGS. 4A and 4B, if the player has accrued seven steps by selecting 108*g*, the player's offer 100 is thirty. If the player rejects the offer by picking another selection (or reject input device) 108*a* through 108*f* or 108*h* to 108*x* and generates two additional steps by selecting 108*n*, the player now has accrued nine steps and the offer remains thirty. If the player alternatively obtains eight additional steps by selecting 108*l*, the player now has fifteen accrued steps and the offer changes to seventy. If the player further alternatively obtains nineteen additional steps by selecting 108*j*, the player now has twenty-six accumulated or accrued steps and, in this embodiment, the player exceeds a termination limit of twenty-five steps. The game ends and preferably provides a consolation award 114 to the player.

The game includes any associated distribution of the steps with the offers that satisfies the game math for a particular implementation of the present invention. FIGS. 4A and 4B illustrate that the range of or the groupings of the displayed steps become smaller for larger offers, whereby the lowest offer has six associated steps and the highest offer has only one associated step. The distribution includes alternatively associating an equal amount of steps with each offer, associating a larger amount of steps with larger offers or randomly associating the steps and offers.

The game further includes any suitable termination limit that satisfies the game math for a particular implementation of the present invention. The termination limit is adapted to be associated with more than one step, for example the last four steps, so that if the player exceeds any of these steps, the game revokes the previous offer. However, the game preferably sets a termination limit that is equal to or exceeds the highest step associated with an offer. That is, FIGS. 4A and 4B display that twenty-five accrued displayed steps yield the top offer of five hundred. The game therefore preferably does not set the termination limit below twenty-five. The game, however, includes setting a termination limit that is higher than twenty-five accrued steps. The game also includes structuring the step generation grid such that the player may exceed the termination limit with one selection (i.e., the steps associated with that selection is greater than the termination limit).

One embodiment of the present invention employs a cap on the termination limit. In the example of FIG. 4B, if the game provides the player with three picks, the top three step generations include twenty-five, twenty-three and twenty-three, whereby a limit of seventy-two is useless. It should be appreciated that the game preferably includes a termination limit game whereby the steps accrued can surpass the termination limit or alternatively reach the limit. Preferably, the player's accrued steps must be able to surpass the termination limit.

In FIGS. 4A and 4B, the offers remaining display 104 illustrates that the game initially provides the player with three offers. The present invention includes providing the player with any number of offers, including not limiting the number of offers. The accrued steps and the termination limit eventually force the player into a dilemma over whether or not to reject the offer. If the limit in FIGS. 4A and 4B is twenty-five, then the limit can be surpassed upon the second offer, regardless of the initial offer. In known offer and acceptance games, such as that illustrated in FIG. 3, not limiting the offers ruins the game because the player can reject offers until receiving a desired offer.

The present invention preferably provides a suitable visual and or audiovisual message 118 outlining the number of offers and the risk associated with rejecting offers. The message 118 states the player can try up to two times to increase an initial offer (i.e., three offers total) without exceeding a limit of twenty-five. The player therefore preferably knows the number of possible picks (i.e., three) and the termination limit (i.e., twenty-five). The game alternatively does not disclose one or more of these parameters. The game can alternatively include a maximum amount of the offer, which when achieved, terminates the game. Accordingly, the present invention provides an offer acceptance bonus game with a plurality of different termination conditions (i.e., the termination limit, number of picks or offers and the offer amount).

Figure 5A:
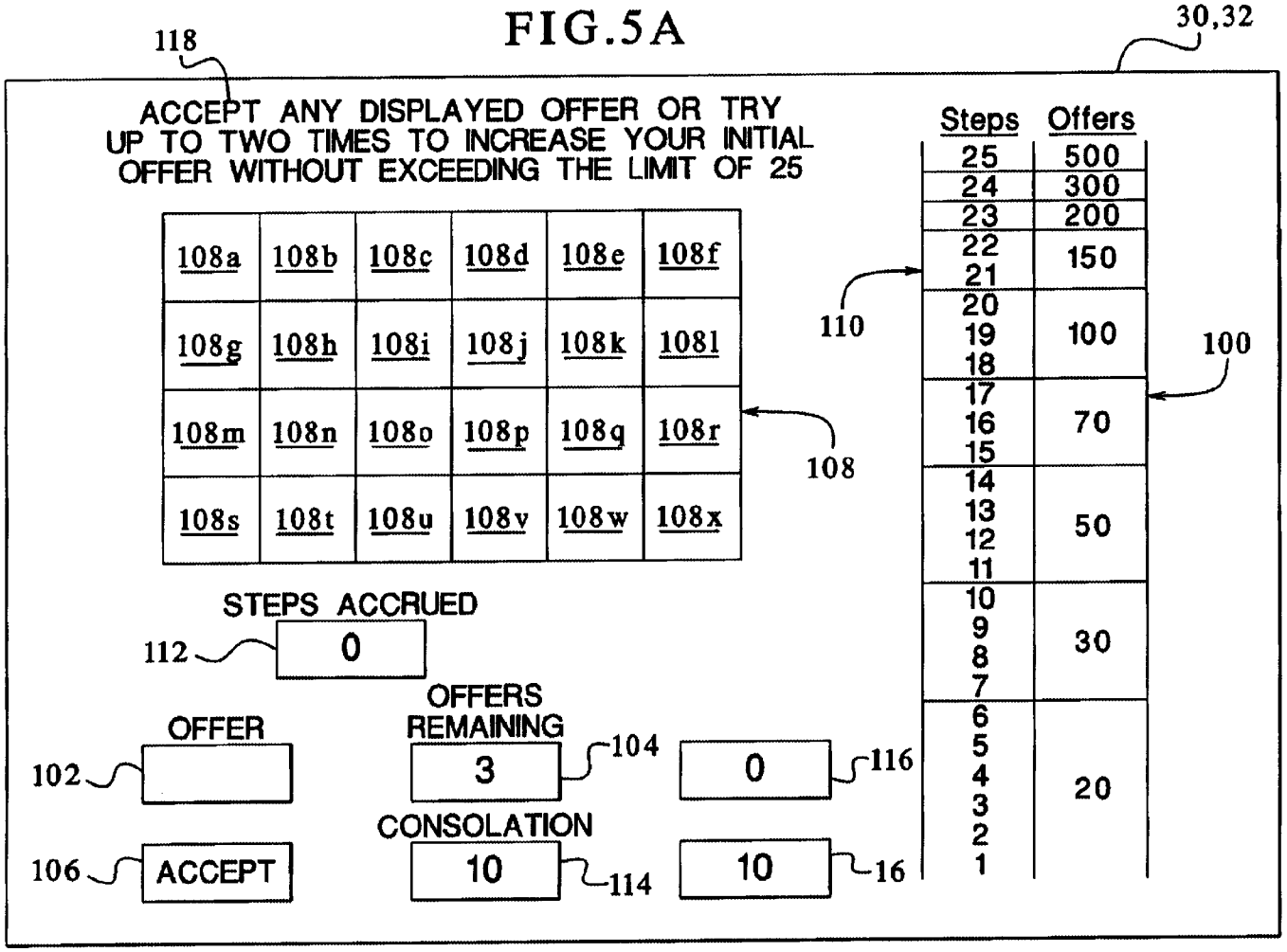
FIGS. 5A through 5D are front elevational views of one of the display devices of FIGS. 1A and 1B illustrating one general example of the embodiment disclosed in FIGS. 4A and 4B.

Referring now to FIGS. 5A through 5D, one general example of the preferred embodiment of the present invention is illustrated. FIG. 5A illustrates that the player is initially provided three offers in the offers remaining display 104, the game has yet to pay the player any credits as indicated by the paid display 116 and the player has ten credits remaining from other gaming activity as indicated by the credit display 16. The steps accrued display 112 indicates that the player has yet to accrue any steps. The consolation display 114 indicates a consolation award of ten, and the game displays the potential offers 100 and the steps 110 necessary to obtain the offers.

Figure 5B:
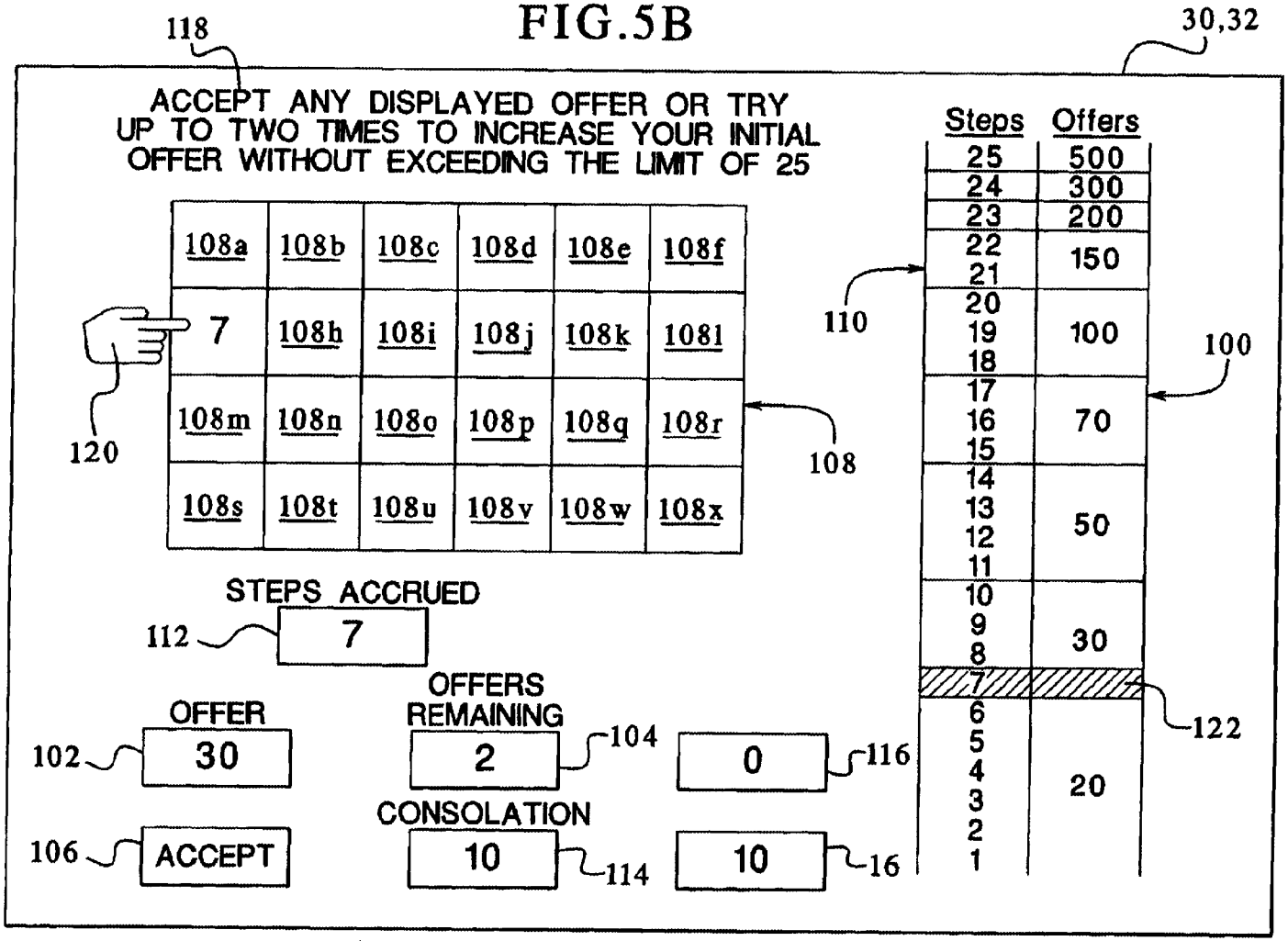

Referring to FIG. 5B and employing the revealed step generation grid of FIG. 4B, when the player 120 picks the selection 108*g,* the game reveals that the player initially accrues seven steps, as further indicated in the steps accrued display 112. The player's remaining offers decrease to two as indicated by the offers remaining display 104. The seven accrued steps yield an initial offer of thirty, as indicated by the current offer display 102 and by an indicator 122 associating the displayed steps 110 to the current offer 100. The game has yet to pay the player, as indicated by the paid display 116.

The game may include a non-instantaneous or delayed revealing of the number of steps associated with the pick of a selection which provides added excitement and entertainment to the game. The game includes not initially revealing the steps behind the selection 108*g* or the update of the steps accrued display 112. The displayed steps 110 increment, e.g., one step, two steps, three steps, etc., until reaching the accrued and displayed number of steps 110. After the indicator 122 stops on the accrued and displayed number of steps 110, the game displays the generated number of steps associated with or masked by the selection 108*g* and the accrued steps in the display 112.

In the non-instantaneous or delayed reveal, the player watches the indicator 122 move hoping that it moves to a position designating a valuable offer, but also hoping that the limit is not exceeded. It should be appreciated that separate steps accrued display 112 is not necessary and includes being combined with the indicator 122, as illustrated below in FIG. 6. Furthermore, the game includes not displaying the number of generated steps when that information is ultimately revealed by the indicator 122.

Figure 5C:
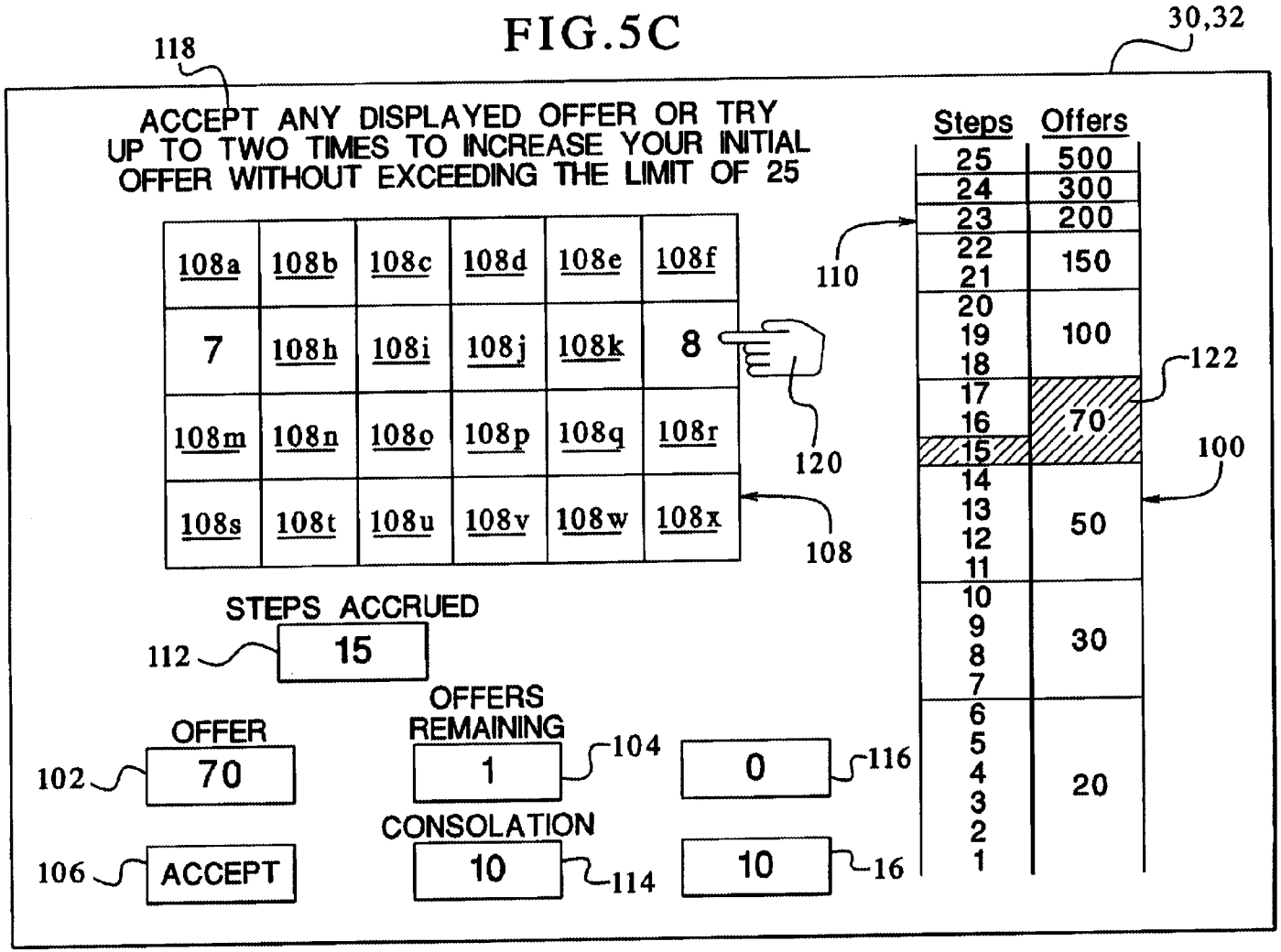

Referring to FIG. 5C and employing the revealed step generation grid of FIG. 4B, when the player 120 risks the offer of thirty and picks the selection 108*l,* the game preferably non-instantaneously reveals that the player accrues eight more steps for a total of fifteen steps 110 as indicated in the steps accrued display 112. The player has only one remaining offer as indicated by the offers remaining display 104. The fifteen accrued steps yield an increased offer of seventy, as indicated by the current offer display 102 and by an indicator 122 associating the accrued steps to the current offer 100. The game has yet to pay the player, as indicated by the paid display 116.

If the game associated each displayed number of steps 110 with a solution only once or otherwise reveals the possible numbers that the player can generate, the game enables the player to optimally play the game. That is, a player with the time and ability is able to determine the expected value for each offer and acceptance situation and make an optimal decision. By providing the player's current offer, the offers available, the set of steps that the player can generate via the displayed steps 110, the game termination limit and the consolation value, the game enables the player to optimally play the game. In FIG. 5C, the player risks the thirty offer and receives the seventy offer knowing that, at worst, the player will receive the consolation award of ten credits.

As illustrated in FIGS. 5A through 5D, the game preferably randomly associates the number of steps with the selection 108*a* through 108*x* once and maintains the order throughout the game. The game therefore preferably does not enable the player to reselect a previously picked selection and in turn reveals or unmasks all previously picked selections throughout the game. The game alternatively reshuffles or redistributes the numbers of steps associated with the selections 108*a* through 108*x* after each offer and thereby provides a new order of steps associated with the selections 108*a* through 108*x*. In an alternative embodiment, the game enables the player to pick the same selections 108*a* through 108*x* two or more times and enables the same number of steps to be generated whether or not the player picks the same selections a plurality of times.

The present invention further includes weighting the number of steps in a table such that at least one particular number of steps is chosen more often than at least one other particular number of steps.

Figure 5D:
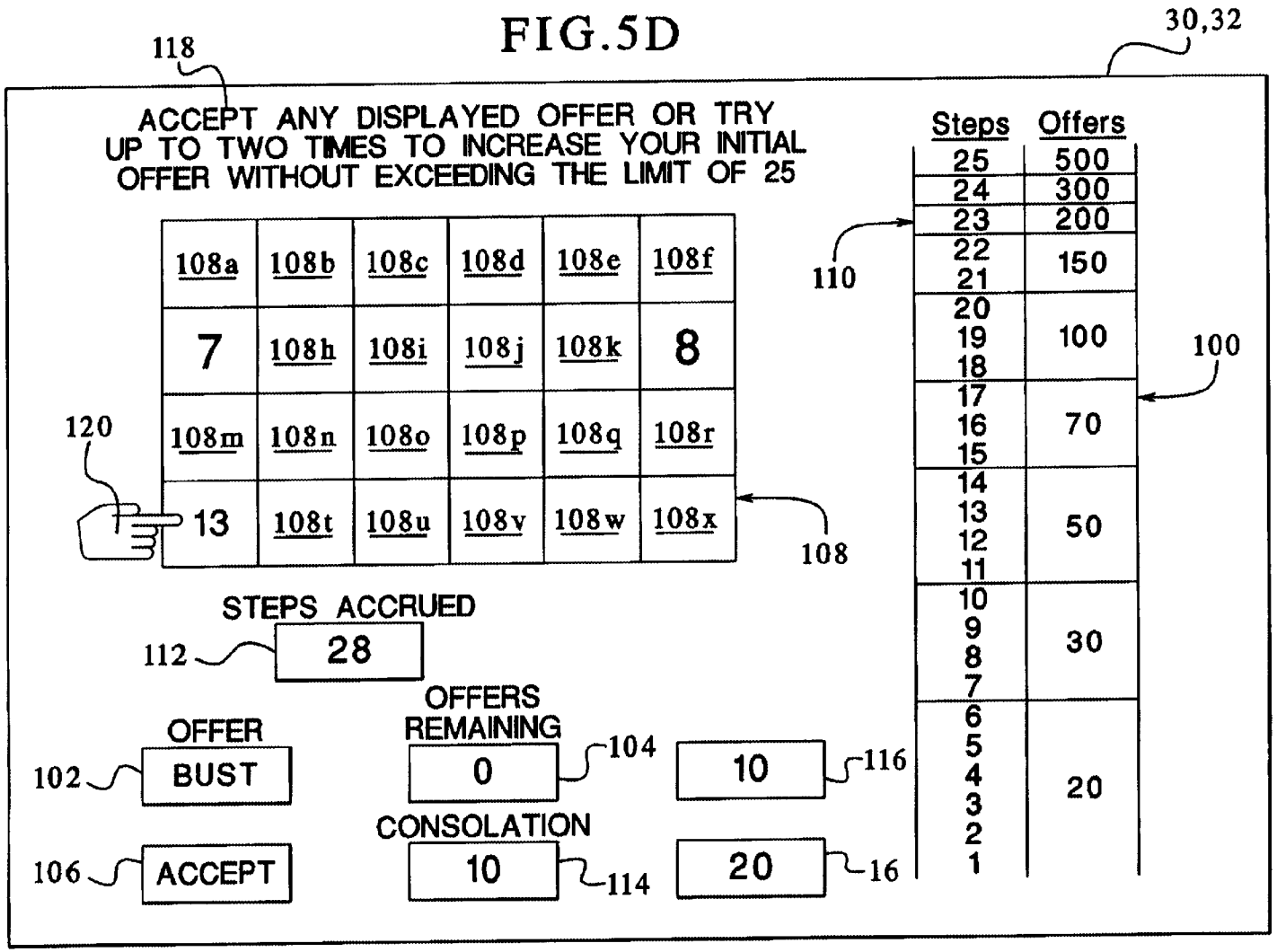

Referring to FIG. 5D and employing the revealed step generation grid of FIG. 4B, when the player 120 risks the seventy offer and picks the selection 108*s,* the game preferably non-instantaneously reveals that the player accrues thirteen more steps for a total of twenty-eight, as further indicated in the steps accrued display 112. The twenty-eight accrued steps exceeds the termination limit of twenty-five displayed steps 110, which the game discloses to the player in the message 118. Exceeding the termination limit yields a "BUST" or other suitable message indicated by the current offer display 102. The game provides the player the consolation award of ten, as indicated by the paid display 116 and updates the player's total awards to twenty, as indicated by the credit display 16.

Display Embodiments

Figure 6:
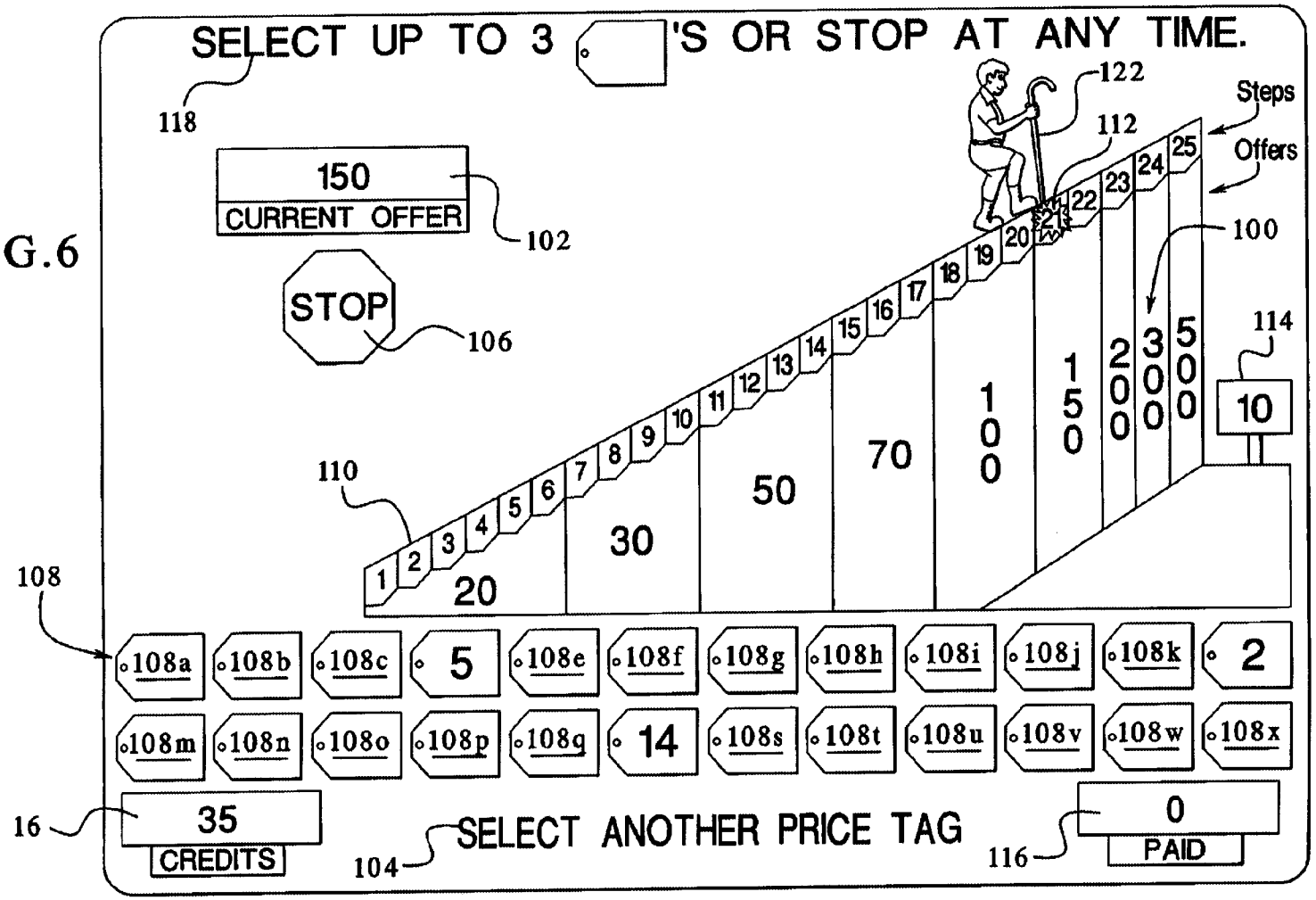
FIG. 6 is a front elevational view of one of the display devices of FIGS. 1A and 1B illustrating one display embodiment of the present invention.

Referring now to FIG. 6, one display embodiment of the present invention is illustrated including a plurality of offers 100, a current offer display 102, an offers remaining display 104, an accept input device 106, a plurality of selections, 108*a* through 108*x*, a plurality of displayed steps 110 as associated with the offers 100, a steps accrued display 112, a consolation award indicator 114, a paid display 116, a visual or audiovisual message 118 and an indicator 122 associating the accrued steps with a current offer 100. The steps accrued display 112 cooperates with the indicator 122. In the preferred display embodiment, the offers remaining display 104 merely indicates that the game will generate another offer, not the number of additional offers. The theme of the game which includes a mountain displaying the steps one through twenty-five and offers associated with each step and a mountain climber or indicator 122 indicate that the player must exceed the termination limit of twenty-five to end the game. The preferred non-instantaneous or delayed reveal includes the mountain climber starting at the bottom of the mountain and incrementing up the mountain the number of steps generated after the player picks a selection to the accrued number of displayed steps 110.

In the embodiments illustrated in FIGS. 4A, 4B, 5A, 5B, 5C, 5D and 6, the display which shows the steps, related offers and other information is a monitor and in particular a touch screen. It should be appreciated that the present invention also contemplates displaying the steps and offers using any suitable mechanical device. The steps could be displayed by the mechanical device at any desired angle. It should also be appreciated that any suitable alternative random mechanical or non-mechanical generator or method such as such as multi-sided dice, wheels and the like or any suitable game may be implemented for determining the number of steps. The number of steps may be player generated, processor generated or a combination of both.

Alternative Embodiments

In one alternative embodiment, obtaining a predetermined number of steps or offers is a prerequisite to advancing to another game (not illustrated), wherein the player is enabled to win further awards. In such an embodiment, the player may wish to forgo optimally playing the game of the present invention to achieve the requisite number of steps or awards to advance to the next game. Referring to the preferred display embodiment of FIG. 6, in one example, the gaming device 10 requires the player to achieve at least twenty-two steps in the game of the present invention to advance to another game (not illustrated). A player who is currently on step twenty-one with an offer remaining might normally wish to stop or accept the offer, especially since both steps twenty-one and twenty-two yield an offer of one hundred fifty. Knowing that the player must reach step twenty-two to advance, however, may persuade the player to risk the offer of one hundred fifty even though any generated step greater than four will cause the player's accrued steps to exceed the termination limit.

In another alternative embodiment, the game randomly generates the termination limit from a plurality of termination limits. In the preferred embodiment disclosed above, the termination limit of twenty-five is a constant from game to game. Alternatively, the game generates the termination limit at the beginning of each game and displays it to the player. Randomly generating the termination limit adds complexity to determining the optimal strategy on a multi-game basis and adds variety to the game. The game includes randomly generating the termination limit from a database of termination limits, wherein each entry has an equal likelihood of being generated or wherein one or more entries is weighted such that one termination limit is more likely to be randomly generated than at least one other termination limit.

In a further alternative embodiment, the selections are adapted to have functionality in addition to advancing the player toward or away from the termination point. In one implementation of the multifunction selection embodiment, one or more of the selections has a modifier associated with it. This modifier, for example, multiplies, adds to or subtracts from, etc., a current offer. In another implementation of the multifunction selection embodiment, one or more of the selections increases or decreases the number of offers available to the player.

In a further alternative embodiment, the game incorporates a method to eliminate one or more of the selections that would cause the step indicator to exceed the termination limit if the player selects that selection. This may be accomplished in a variety of ways. One method includes one or more of the selections adapted so that when selected, the game removes one or more termination selections and displays a message informing the player of such removal. Another method includes granting the player, at some predetermined point in the game, a fixed number of opportunities to eliminate terminating selections. Alternatively, the grant of one or more terminating selections removals occurs randomly or after the achievement of a predetermined condition.

In a further embodiment, the game provides additional awards upon the player's satisfaction of a predetermined condition. For example, the game includes providing an additional number of credits or a multiplier for achieving the highest allowable number of steps, such as twenty five, in a single or predetermined number of tries. In another example, picking a predetermined combination of selections yields an additional number of credits or a credit multiplier for the player.

While the present invention is described in connection with what is presently considered to be the most practical and preferred embodiments, it should be appreciated that the invention is not limited to the disclosed embodiments, and is intended to cover various modifications and equivalent arrangements included within the spirit and scope of the claims. Modifications and variations in the present invention may be made without departing from the novel aspects of the invention as defined in the claims, and this application is limited only by the scope of the claims.

The invention is hereby claimed as follows:

1. A gaming device comprising:

a plurality of selections displayed to a player;

means for enabling the player to pick said selections;

at least one step associated with each selection, wherein a plurality of steps are associated with each of a plurality of said selections;

means for accruing a number of steps associated with the selections picked by the player until said accrued number of steps exceed a termination limit which is equal to a predetermined number of accrued steps that is greater than one;

a plurality of offers associated with said accrued number of steps; and means for enabling said player to accept or reject said offers.

2. The gaming device of claim 1, which includes a consolation award provided to said player when said accrued number of steps exceeds said termination limit.

3. The gaming device of claim 1, wherein the number of steps associated with each selection is at least one.

4. The gaming device of claim 1, wherein the number of steps associated with at least one selection is zero.

5. The gaming device of claim 1, wherein the number of steps associated with at least one selection is negative.

6. The gaming device of claim 1, wherein a modifier is associated with at least one selection.

7. The gaming device of claim 1, wherein at least one of the selections alters the termination limit.

8. The gaming device of claim 1, which includes one of said offers associated with each number of accrued steps.

9. The gaming device of claim 1, which includes one of said offers associated with at least one range of accrued number of steps.

10. The gaming device of claim 1, which includes an indicator adapted to non-instantaneously reveal said number of steps associated with each selection.

11. The gaming device of claim 1, which includes an indicator adapted to reveal said number of steps in increments.

12. The gaming device of claim 1, wherein means for eliminating one or more unpicked selections from said plurality of displayed selections is associated with one of said selections.

13. A gaming device having an offer and acceptance bonus game comprising:

a plurality of different offers adapted to be provided to a player;

a limit on said number of offers provided to said player;

at least one step associated with each offer, wherein different numbers of steps are associated with said plurality of different offers;

means for accumulating said number of steps;

a termination limit equal to a predetermined number of accumulated steps; and means for enabling the player to accept or reject offers, whereby the offer and acceptance bonus game ends when the player accepts an offer, the number of offers provided to the player equals the limit of the number of offers, or the accumulated number of steps associated with the offers provided to the player exceeds the termination limit.

14. The gaming device of claim 13, which includes at least one step towards termination associated with each offer.

15. The gaming device of claim 13, which includes a consolation award provided to said player when the accumulated number of steps exceed said termination limit.

16. The gaming device of claim 13, which includes an indicator adapted to non-instantaneously reveal said offers.

17. A gaming device having an offer acceptance bonus game comprising:

a display device;

a processor adapted to communicate with said display device;

a plurality of selections wherein each selection is associated with one or more steps;

a plurality of offers adapted to be provided to a player, wherein each offer is associated with a number of steps;

means for enabling the player to accept or reject said offers; and movable indicator means displayed by said display device and controlled by said processor for non-instantaneously revealing the number of steps associated with each selection to indirectly by display of movement provide the player with either one of said offers or a termination event in the bonus game wherein the termination event includes a predetermined number of accumulated steps associated with the offers provided to the player.

18. A gaming device comprising:

a display device; and a processor adapted to communicate with said display device, said display device and said processor adapted to:

(a) begin a game;

(b) enable a player to pick any one of a plurality of selections;

(c) generate at least one or more steps associated with said picked selection;

(d) accumulate said steps;

(e) end the game if said accumulated steps exceed a termination limit that is equal to a predetermined number of accumulated steps;

(f) provide an offer to said player based on said accumulated steps if said accumulated steps do not exceed said termination limit;

(g) enable said player to accept or reject said offer;

(h) award said offer to said player if said player accepts said offer; and (i) repeat (b) to (h) at least once unless said player accepts said offer or said accumulated steps exceeds said termination limit.

19. The gaming device of claim 18, wherein the display device is adapted to display player selectable selections.

20. The gaming device of claim 18, wherein the processor is adapted to provide a consolation award for said player if said accumulated steps exceed said termination limit.

21. The gaming device of claim 18, wherein the processor is adapted to end said game if the number of offers provided to said player meets an offer limit.

22. The gaming device of claim 18, wherein the processor is adapted to provide an accepted offer to the player.

23. The gaming device of claim 18, wherein the processor and display device are adapted to non-instantaneously reveal said step towards termination.

24. A gaming device comprising:

a display device; and a processor adapted to communicate with said display device, said display device and said processor adapted to:

(a) begin a game;

(b) generate at least one or a plurality of steps;

(c) display the generated steps to a player;

(d) accumulate said generated steps;

(e) end the game if said accumulated steps exceed a termination limit that is equal to a predetermined number of accumulated steps;

(f) provide an offer to said player based on said accumulated steps if said accumulated steps do not exceed said termination limit;

(g) enable said player to accept or reject said offer;

(h) award said offer to said player if said player accepts said offer; and (i) repeat (b) to (h) at least once unless said player accepts said offer or said accumulated steps exceeds said termination limit.

25. The gaming device of claim 24, which includes a mechanical step generator adapted to communicate with said processor.

26. The gaming device of claim 24, wherein the display device includes a video display.

27. The gaming device of claim 24, wherein the display device includes a mechanical display.

28. A gaming device comprising:

a display device;

a processor adapted to communicate with said display device and adapted to accrue a plurality of steps;

a step generator adapted to communicate with said processor;

a plurality of offers associated with said accrued steps, wherein at least one offer is associated with a plurality of accrued steps;

a termination limit including a plurality of accrued steps;

at least one offer acceptance indicator adapted to communicate with said processor; and at least one offer rejection indicator adapted to communicate with said processor, whereby the step generator is adapted to generate said steps, the processor is adapted to accrue said steps and the display device is adapted to display said steps and associated offers until the accrued steps exceed the termination limit, a player uses the offer rejection indicator to reject all of the offers associated with the accrued steps or said player uses the offer acceptance indicator to accept an offer associated with said accrued steps.

29. A method of operating a gaming device, said method comprising the steps of:

(a) generating at least one or a plurality of steps;

(b) accumulating said steps;

(c) ending a game if said accumulated steps meet or exceed a termination limit;

(d) providing an offer to a player based on paid accumulated steps if said accumulated steps do not meet or exceed a termination limit of a predetermined number of accumulated steps;

(e) enabling said player to accept or reject said offer;

(f) awarding said offer to said player if said player accepts said offer; and (g) repeating steps (a) to (f) at least once if said player rejects said offer.

30. The method of claim 29, which is stored on a memory device.

31. The method of claim 29, wherein the offer provided to the player is an offer associated with the number of accumulated steps.

32. The method of claim 29, wherein the offer provided to the player is the sum of the offers associated with each generated step.

* * * * *

UNITED STATES PATENT AND TRADEMARK OFFICE

CERTIFICATE OF CORRECTION

PATENT NO. : 6,648,754 B2 
DATED : November 18, 2003
INVENTOR(S) : Anthony J. Baerlocher et al.

It is certified that error appears in the above-identified patent and that said Letters Patent is hereby corrected as shown below:

Title page, Item [54] and Column 1, line 2,
Title, please insert the word -- A -- between the words "WITH" and "TERMINATION"

Column 11,
Line 28, please delete the second occurrence of the words "such as"

Signed and Sealed this

Sixth Day of July, 2004

JON W. DUDAS
*Acting Director of the United States Patent and Trademark Office*